US009805655B2

(12) United States Patent
Zhang et al.

(10) Patent No.: US 9,805,655 B2
(45) Date of Patent: Oct. 31, 2017

(54) PIXEL CIRCUIT AND DRIVING METHOD THEREOF, DISPLAY DEVICE

(71) Applicants: Boe Technology Group Co., Ltd., Beijing (CN); Beijing Boe Display Technology Co., Ltd., Beijing (CN)

(72) Inventors: Xu Zhang, Beijing (CN); Zhihua Sun, Beijing (CN); Jianming Wang, Beijing (CN); Weichao Ma, Beijing (CN); Seungmin Lee, Beijing (CN); Honglin Zhang, Beijing (CN); Zhihao Zhang, Beijing (CN)

(73) Assignees: BOE TECHNOLOGY GROUP CO., LTD., Bejing (CN); BEIJING BOE DISPLAY TECHNOLOGY TECHNOLOGY CO., LTD, Beijing (CN)

( * ) Notice: Subject to any disclaimer, the term of this patent is extended or adjusted under 35 U.S.C. 154(b) by 0 days.

(21) Appl. No.: 14/913,325

(22) PCT Filed: Aug. 13, 2015

(86) PCT No.: PCT/CN2015/086863
§ 371 (c)(1),
(2) Date: Feb. 19, 2016

(87) PCT Pub. No.: WO2016/155193
PCT Pub. Date: Oct. 6, 2016

(65) Prior Publication Data

US 2017/0039947 A1 Feb. 9, 2017

(30) Foreign Application Priority Data

Apr. 1, 2015 (CN) ..... 2015 1 0152814

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0439* (2013.01);
(Continued)

(58) Field of Classification Search
CPC .. G09G 3/3258; G09G 3/3233; G09G 3/3241; G09G 3/32; H02M 3/156; H05B 33/0827
(Continued)

(56) References Cited

U.S. PATENT DOCUMENTS 8,242,995 B2 * 8/2012 Lee ..... G09G 3/3241 315/169.1
9,318,052 B2 * 4/2016 Choo ..... G09G 3/3258
(Continued)

FOREIGN PATENT DOCUMENTS

CN 102346999 2/2012
CN 102654973 9/2012
(Continued)

OTHER PUBLICATIONS

International Search Report and Written Opinion from PCT/CN15/86863 dated Dec. 21, 2015.
(Continued)

*Primary Examiner* — Fred Tzeng
(74) *Attorney, Agent, or Firm* — Calfee, Halter & Griswold LLP

(57) ABSTRACT

The present invention provides a pixel circuit and a driving method thereof, as well as a display device. The pixel circuit comprises a drive transistor and a first energy storage element, a source of the drive transistor being connected with a first end of the first energy storage element. The pixel circuit further comprises a driving module, and has a reset
(Continued)

voltage input terminal, a data voltage input terminal, a working voltage input terminal and a plurality of control signal input terminals. The pixel circuit provided by the present invention can prevent the driving current flowing through the electroluminescent unit from being influenced by the turn-on threshold value of the corresponding drive transistor, thereby solving the problem of non-uniform display brightness caused by drift of the turn-on threshold value of the drive transistor thoroughly.

20 Claims, 4 Drawing Sheets

(52) U.S. Cl.
CPC ..... *G09G 2300/0819* (2013.01); *G09G 2300/0852* (2013.01); *G09G 2300/0861* (2013.01); *G09G 2310/08* (2013.01); *G09G 2320/0223* (2013.01); *G09G 2320/043* (2013.01)

(58) Field of Classification Search
USPC ..... 345/211
See application file for complete search history.

(56) References Cited

U.S. PATENT DOCUMENTS

2005/0023992 A1* 2/2005 Lee ..... H05B 33/0827 315/291
2007/0091033 A1 4/2007 Nakamura
2008/0174292 A1* 7/2008 Nishida ..... H02M 3/156 323/284
2010/0253608 A1 10/2010 Kim et al.
2012/0327064 A1* 12/2012 Qi ..... G09G 3/32 345/212
2013/0043802 A1 2/2013 Han et al.
2014/0022150 A1 1/2014 Guo et al.
2015/0029079 A1 1/2015 Miyazawa et al.
2016/0163243 A1* 6/2016 Park ..... G09G 3/3258 345/205
2016/0189606 A1* 6/2016 Chen ..... G09G 3/3233 345/214
2016/0240134 A1* 8/2016 Yang ..... G09G 3/3233

FOREIGN PATENT DOCUMENTS

CN 102708789 10/2012
CN 103531151 1/2014
CN 103839520 6/2014
CN 104200778 12/2014
CN 104200779 12/2014
CN 104409047 3/2015
CN 104464625 3/2015
CN 104700781 6/2015
KR 1020040008684 1/2004
KR 1020050049686 5/2005
KR 20130026338 3/2013

OTHER PUBLICATIONS

Office action from Chinese Application No. 201510152814.1 dated Sep. 5, 2016.

* cited by examiner

PIXEL CIRCUIT AND DRIVING METHOD THEREOF, DISPLAY DEVICE

RELATED APPLICATIONS

The present application is the U.S. national phase entry of PCT/CN2015/086863 with an International filing date of Aug. 13, 2015, which claims the benefit of Chinese Application No. 201510152814.1, filed Apr. 1, 2015, the entire disclosures of which are incorporated herein by reference.

FIELD OF THE INVENTION

The present invention relates to the field of display technology, particularly to a pixel circuit and a driving method thereof, as well as a display device.

BACKGROUND OF THE INVENTION

The organic light emitting diode (OLED) is one of the hotspots in the research field of panel display nowadays. As a current mode light emitting device, it has been more and more applied in high performance displays in virtue of its characteristics of self-luminous, quick response, wide visual angle and being capable of being fabricated on a flexible substrate. At present, in displays such as the mobile phone, PDA, digital camera, the OLED has begun to replace the conventional liquid crystal display (LCD). The design of the pixel driving circuit is the core technology of the OLED display, and has important research significance. Different from the TFT (thin film transistor)-LCD which makes use of stable voltages to control the brightness, the OLED belongs to current driving, which needs stable currents to control lighting. Due to the process procedure and the device aging, in an original 2T1C driving circuit (including two thin film transistors and a capacitance), threshold voltages of respective pixel points for driving the TFT are non-uniform. Thus it results in variation of the current that flows through the OLED of each pixel point, which renders the display brightness non-uniform, thereby influencing the display effect of the whole image.

SUMMARY OF THE INVENTION

An object of the present invention is to provide a pixel circuit so as to avoid non-uniform display brightness caused by drift of the turn-on threshold value of the drive transistor.

A first aspect of the present invention provides a pixel circuit, comprising a drive transistor, a first energy storage element and a driving module, and having a reset voltage input terminal, a data voltage input terminal, a working voltage input terminal and a plurality of control signal input terminals; wherein, a source of the drive transistor is connected with a first end of the first energy storage element;

the driving module is connected with the first end of the first energy storage element, a second end of the first energy storage element, a gate of the drive transistor, the reset voltage input terminal, the data voltage input terminal and the working voltage input terminal, and connects the plurality of control signal input terminals; the driving module has a first node, when the first node and the second end of the first energy storage element are both floated, a voltage difference between the first node and the first end of the first energy storage element keeps constant;

the driving module conducts the working voltage input terminal with the first end of the first energy storage element when a first control signal input terminal is inputted with an effective level; conducts the first node with the reset voltage input terminal when a second control signal input terminal is inputted with an effective level; conducts the data voltage input terminal with the gate of the drive transistor and the second end of the first energy storage element when a third control signal input terminal is inputted with an effective level; and conducts the first node with the gate of the drive transistor when a fourth control signal input terminal is inputted with an effective level.

According to an embodiment, the driving module comprises:

a first switch transistor connected between the working voltage input terminal and the first end of the first energy storage element, a gate of the first switch transistor being connected with the first control signal input terminal;

a second switch transistor connected between the reset voltage input terminal and the first node, a gate of the second switch transistor being connected with the second control signal input terminal;

a third switch transistor connected between the data voltage input terminal and the gate of the drive transistor;

a fifth switch transistor connected between the second end of the first energy storage element and the gate of the drive transistor;

a fourth switch transistor connected between the first node and the gate of the drive transistor, a gate of the fourth switch transistor being connected with the fourth control signal input terminal; and a second energy storage element, a first end of the second energy storage element being connected with the second end of the first energy storage element, a second end of the second energy storage element being connected with the first node.

According to an embodiment, gates of the third switch transistor and the fifth switch transistor are both connected with the third control signal input terminal, and have a same effective level.

According to an embodiment, the respective switch transistors are all P-type transistors.

According to an embodiment, the effective level of the fourth switch transistor is opposite to the effective level of the third switch transistor and the fifth switch transistor, the fourth control signal input terminal and the third control signal input terminal can be the same input terminal.

According to an embodiment, the first switch transistor and the fourth switch transistor are both P-type transistors; the second switch transistor, the third switch transistor and the fifth switch transistor are all N-type transistors.

According to an embodiment, the first energy storage element and/or the second energy storage element are capacitance.

According to an embodiment, the drive transistor is a P-type transistor.

A second aspect of the present invention provides a method for driving any of the above pixel circuits, comprising a reset phase, a compensation phase and a lighting phase:

in the reset phase, the first control signal input terminal, the second control signal input terminal and the third control signal input terminal are all inputted with a corresponding effective level; the fourth control signal input terminal is inputted with a corresponding ineffective level;

in the compensation phase, the third control signal input terminal is inputted with a corresponding effective level; the first control signal input terminal, the second control signal input terminal and the fourth control signal input terminal are inputted with a corresponding ineffective level;

in the lighting phase, the first control signal input terminal and the fourth control signal input terminal are inputted with a corresponding effective level; the second control signal input terminal and the third control signal input terminal are inputted with a corresponding ineffective level.

A third aspect of the present invention provides a display device comprising any of the above pixel circuits.

The pixel circuit provided by the present invention can prevent the driving current flowing through the electroluminescent unit from being influenced by the turn-on threshold value of the corresponding drive transistor, thereby solving the problem of non-uniform display brightness caused by drift of the turn-on threshold value of the drive transistor thoroughly.

DETAILED DESCRIPTION OF THE INVENTION

In order to make the objects, the technical solutions and the advantages of the embodiments of the present invention clearer, next, the technical solutions in the embodiments of the present invention will be described clearly and completely with reference to the drawings in the embodiments of the present invention. Apparently, the embodiments described are only a part rather than all of the embodiments of the present invention. Based on the embodiments of the present invention, all the other embodiments obtained by the ordinary skilled person in the art on the premise of not paying any creative work belong to the protection scope of the present invention.

Figure 1:
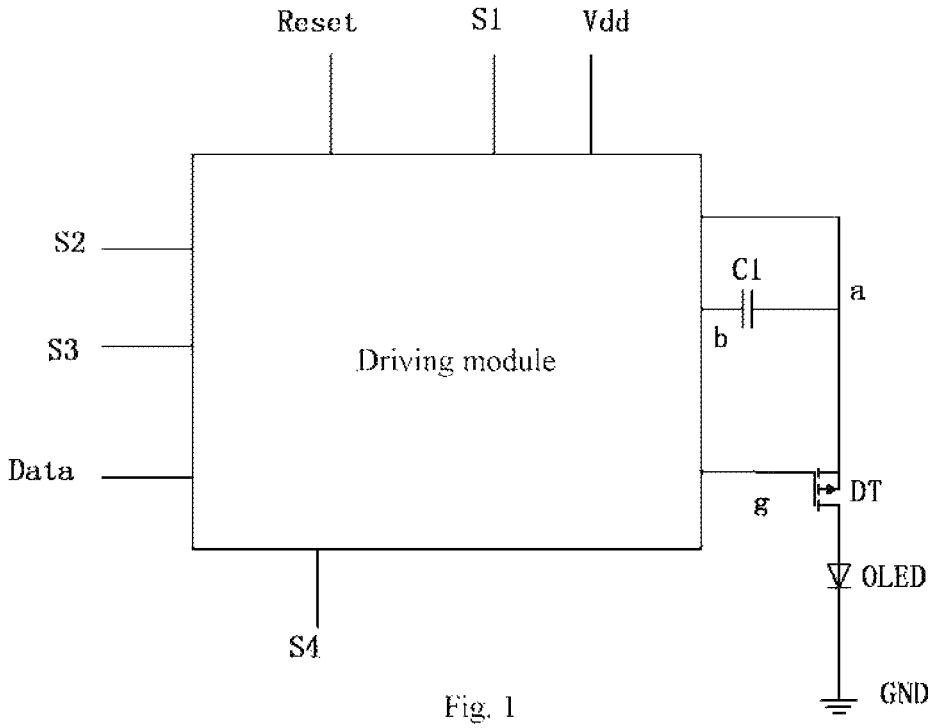
FIG. 1 is a structural schematic view of a pixel circuit provided by an embodiment of the present invention.

The pixel circuit provided by an embodiment of the present invention is as shown in FIG. 1, the pixel circuit can comprise: a drive transistor DT, a first energy storage element C1, an electroluminescent element OLED and a driving module. The pixel circuit has a reset voltage input terminal Reset, a data voltage input terminal Data, a working voltage input terminal Vdd and four control signal input terminals S1, S2, S3, S4. Preferably, the drive transistor can be a P-type transistor.

A source of the drive transistor DT is connected with a first end a of the first energy storage element C1.

The drive module is connected with the first end a of the first energy storage element C1, a second end b of the first energy storage element C1, a gate g of the drive transistor DT, the reset voltage input terminal Reset, the data voltage input terminal Data and the working voltage input terminal Vdd, and connects the four control signal input terminals S1, S2, S3, S4. The driving module has a first node inside (not shown in the figure), when the first node and the second end b of the first energy storage element C1 are both floated, a voltage difference between the first node and the first end a of the first energy storage element C1 keeps constant.

The driving module conducts the working voltage input terminal Vdd with the first end a of the first energy storage element C1 when a first control signal input terminal S1 is inputted with an effective level; conducts the first node with the reset voltage input terminal Reset when a second control signal input terminal S2 is inputted with an effective level; conducts the data voltage input terminal Data with the gate of the drive transistor DT and the second end b of the first energy storage element C1 when a third control signal input terminal S3 is inputted with an effective level; and conducts the first node with the gate of the drive transistor when a fourth control signal input terminal S4 is inputted with an effective level.

The pixel circuit provided by the present invention can make the voltage of the control end of the driving module to contain a component of the turn-on threshold value of the drive transistor. Thus in the display process, the contained turn-on threshold value component can counteract the turn-on threshold value of the drive transistor. In this way, the driving current flowing through the electroluminescent unit can be prevented from being influenced by the turn-on threshold value of the corresponding drive transistor, thereby solving the problem of non-uniform display brightness caused by drift of the turn-on threshold value of the drive transistor thoroughly.

The effective level here should be understood as a level that can make the driving module to turn on the corresponding function. For example, for the first control signal input terminal S1, its corresponding effective level should be understood as a level that can conduct the working voltage input terminal with the first end of the first energy storage element. Correspondingly, the effective level to which the second control signal input terminal S2 corresponds should be understood as a level that can conduct the first node with the reset voltage input terminal, and so on. For different control signal input terminals, their corresponding effective levels are likely to be different.

Figure 2:
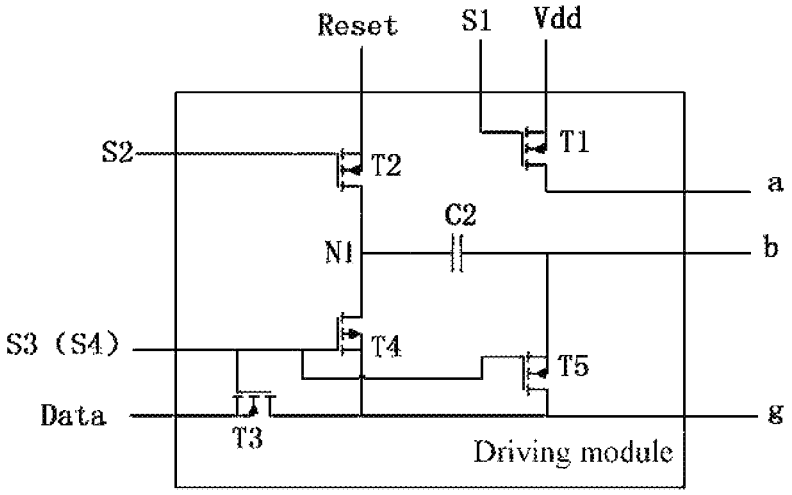
FIG. 2 is a circuit schematic view of a driving module of the embodiment in FIG. 1.

In specific implementation, as shown in FIG. 2, the driving module can comprise: five switch transistors T1, T2, T3, T4, T5 and a second energy storage element C2. A source of the first switch transistor T1 is connected with the working voltage input terminal Vdd, a drain of the first switch transistor T1 is connected with the first end a of the first energy storage element C1, a gate of the first switch transistor T1 is connected with the first control signal input terminal S1. A drain of the second switch transistor T2 is connected with the reset voltage input terminal Reset, a source of the second switch transistor T2 is connected with the first node (denoted as N1 in the figure), a gate of the second switch transistor T2 is connected with the second control signal input terminal S2.

A source of the third switch transistor T3 is connected with the data voltage input terminal Data, a drain of the third switch transistor T3 is connected with the gate g of the drive transistor DT. A source of the fifth switch transistor T5 is connected with the second end b of the first energy storage element C1, a drain of the fifth switch transistor T5 is connected with the gate g of the drive transistor DT. The gates of the third switch transistor T3 and the fifth switch transistor T5 are both connected with the third control signal input terminal S3, and have the same effective level.

A drain of the fourth switch transistor T4 is connected with the first node N1, a source of the fourth switch transistor T4 is connected with the gate g of the drive transistor DT, a gate of the fourth switch transistor T4 is connected with the fourth control signal input terminal S4.

A first end of the second energy storage element C2 is connected with the second end b of the first energy storage element, a second end of the second energy storage element C2 is connected with the first node Ni.

Since the gates of the third switch transistor T3 and the fifth switch transistor T5 are connected with the same control signal input terminal, the third switch transistor T3 and the fifth switch transistor T5 can be controlled to turn on and turn off through a same signal line. In this way, the use of the signal line can be reduced. It is not difficult to understand that in actual applications, the third switch transistor T3 and the fifth switch transistor T5 can also be connected with different control signal lines. Correspondingly, the effective levels of the third switch transistor T3 and the fifth switch transistor T5 also do not have to be consistent.

In specific implementation, the effect level of the fourth switch transistor T4 can be opposite to the effective level of the third switch transistor T3 and the fifth switch transistor T5, the fourth control signal input terminal S4 and the third control signal input terminal S3 can be the same input terminal. In other words, if the third switch transistor T3 and the fifth switch transistor T5 are P-type transistors, the fourth switch transistor T4 will be an N-type transistor. In this way, the number of the signal lines used can be reduced, thereby reducing the area occupied by the pixel circuit.

The first switch transistor T1 and the fourth switch transistor T4 can be both P-type transistors. The second switch transistor T2, the third switch transistor T3 and the fifth switch transistor T5 can be all N-type transistors. The advantage of doing so is that the effective levels (pulse levels) of respective signals for driving the pixel circuit are all high levels. Since the structure of the shift register for outputting a pulse signal of a high level is much simpler than the structure of the shift register for outputting a pulse signal of a low level, the pixel circuit provided by the embodiment of the present invention can reduce design complexity of the driving circuit.

Alternatively, in specific implementation, all the above respective switch transistors can also be P-type transistor. The advantage of doing so is that they can be fabricated using the same process, thereby reducing complexity in fabricating the corresponding display device.

The reset voltage input terminal Reset here can be a ground terminal.

In specific implementation, the first energy storage element C1 and/or the second energy storage element C2 here can be both capacitance. Certainly, in actual applications, other elements with the storage function can also be used based on the design requirement.

In FIG. 1, the anode of the electroluminescent element OLED is connected with the drain of the drive transistor, the cathode is connected to the ground terminal GND. Certainly, in actual applications, the cathode can also be connected with other low voltage input terminals, such as VSS etc.

The present invention further provides a driving method of a pixel circuit, which can be used for driving any of the above pixel circuits, the method comprising a reset phase, a compensation phase and a lighting phase.

In the reset phase, the first control signal input terminal, the second control signal input terminal and the third control signal input terminal are all inputted with a corresponding effective level; the fourth control signal input terminal is inputted with a corresponding ineffective level.

In the compensation phase, the third control signal input terminal is inputted with a corresponding effective level; the first control signal input terminal, the second control signal input terminal and the fourth control signal input terminal are inputted with a corresponding ineffective level.

In the lighting phase, the first control signal input terminal and the fourth control signal input terminal are inputted with a corresponding effective level; the second control signal input terminal and the third control signal input terminal are inputted with a corresponding ineffective level.

Through the driving method provided by the present invention, the driving current flowing through the electroluminescent unit can be prevented from being influenced by the turn-on threshold value of the corresponding drive transistor, thereby solving the problem of non-uniform display brightness caused by drift of the turn-on threshold value of the drive transistor thoroughly.

Figure 3:
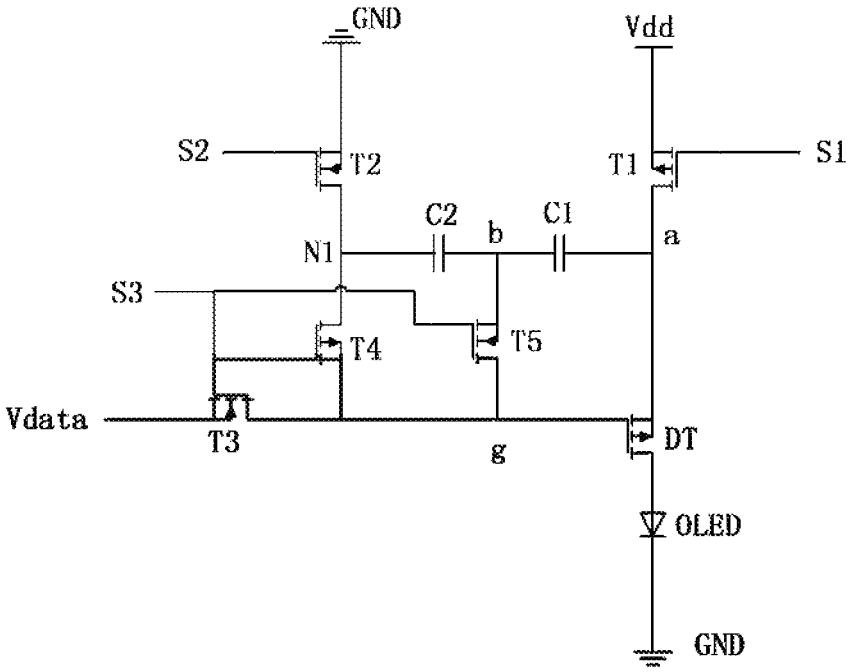
FIG. 3 is a circuit structural view of a pixel circuit provided by an embodiment of the present invention.

Next, a specific circuit structure will be combined to explain the driving method and the working principle of the pixel circuit provided by the embodiment of the present invention. As shown in FIG. 3, which is a possible circuit schematic view of the pixel circuit, comprising five switch transistors T1-T5, a P-type drive transistor DT, an electroluminescent element OLED, a capacitance C1 and a capacitance C2. The switch transistors T1, T2, T3, T4 and T5 constitute a driving module. The switch transistors T1 and T4 can be both P-type transistors, the turn-on level is a low level. The switch transistors T2, T3 and T5 can all be N-type transistors, the turn-on level is a high level. The pixel circuit further has a reset voltage input terminal Reset, a working voltage input terminal Vdd, a data voltage input terminal Data, a ground terminal GND and control signal input terminal S1, S2, S3. The source of the switch transistor T1 is connected with the working voltage input terminal Vdd, the drain of the switch transistor T1 is connected with the first end a of the capacitance C1, the gate of the switch transistor T1 is connected with the control signal input terminal S1. The source of the switch transistor T2 is connected with the first node N1, the drain of the switch transistor T2 is connected with the ground terminal GND, the gate of the switch transistor T2 is connected with the control signal input terminal S1. The gates of the switch transistors T3, T4 and T5 are all connected with the third control signal input terminal S3. The source of the switch transistor T3 is connected with the data voltage input terminal Data, the drain of the switch transistor T3 is connected with the gate g of the drive transistor DT. The source of the switch transistor T4 is connected with the first node N1, the drain of the switch transistor T4 is connected with the gate g of the drive transistor DT. The source of the switch transistor T5 is connected with the gate g of the drive transistor DT, the drain of the switch transistor T5 is connected with the second end b of the capacitance C1. The first end of the capacitance C2 is connected with the second end b of the capacitance C1, the second end of the capacitance C2 is connected with the first node Ni. The anode of the OLED is connected with the drain of the drive transistor DT, the cathode is connected with the ground terminal GND.

Figure 4:
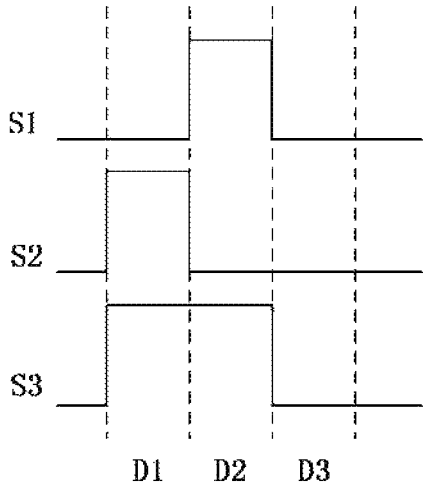
FIG. 4 is a timing diagram of a control signal of a method for driving the pixel circuit in FIG. 3.

FIG. 4 is a timing diagram of key signals in a driving method for driving the pixel circuit as shown in FIG. 3, comprising a reset phase D1, a compensation phase D2 and a lighting phase D3.

Figure 5A:
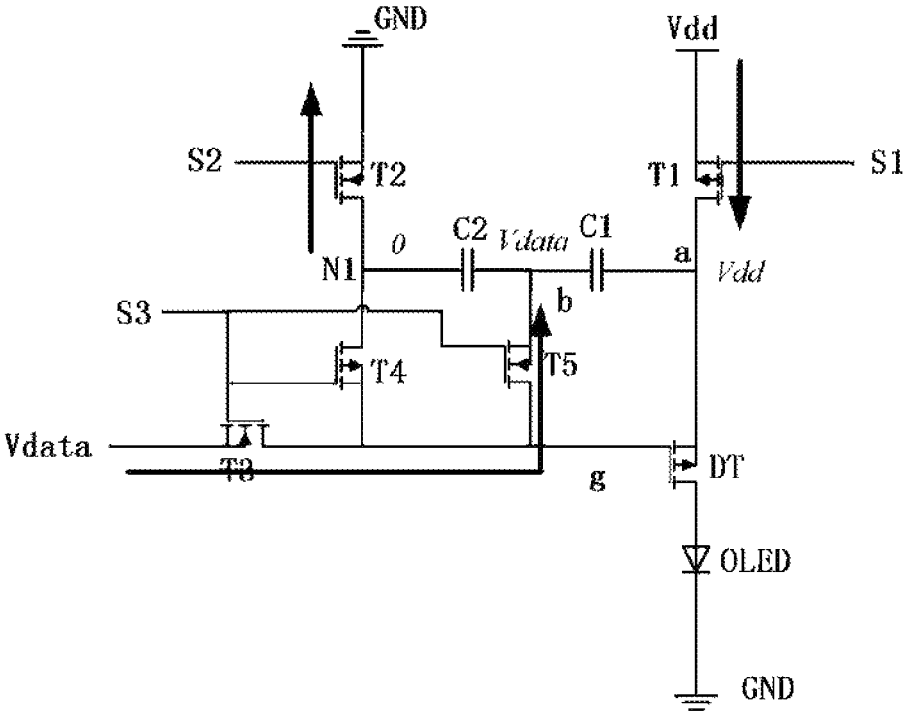
FIG. 5*a* to FIG. 5*c* are schematic views of current flow direction and node voltage value of the pixel circuit in FIG. 3 under different timing sequences.

In the reset phase D1, the control signal input terminal S1 is applied with a low level, the control signal input terminals S2 and S3 are applied with a high level, the data voltage input terminal Data is applied with a data voltage Vdata. The switch transistors T1, T2, T3 and T5 are turned on, the switch transistor T4 is turned off The current flow direction can make reference to FIG. 5*a*. The voltage at end a of the capacitance C1 is set as Vdd, the voltage at end b of the capacitance C1 is set as Vdata, the voltage at the node N1 is set as 0, the voltage across the capacitance C2 are Vdata, the voltage at the first end a of the capacitance C1 is Vdd.

Figure 5B:
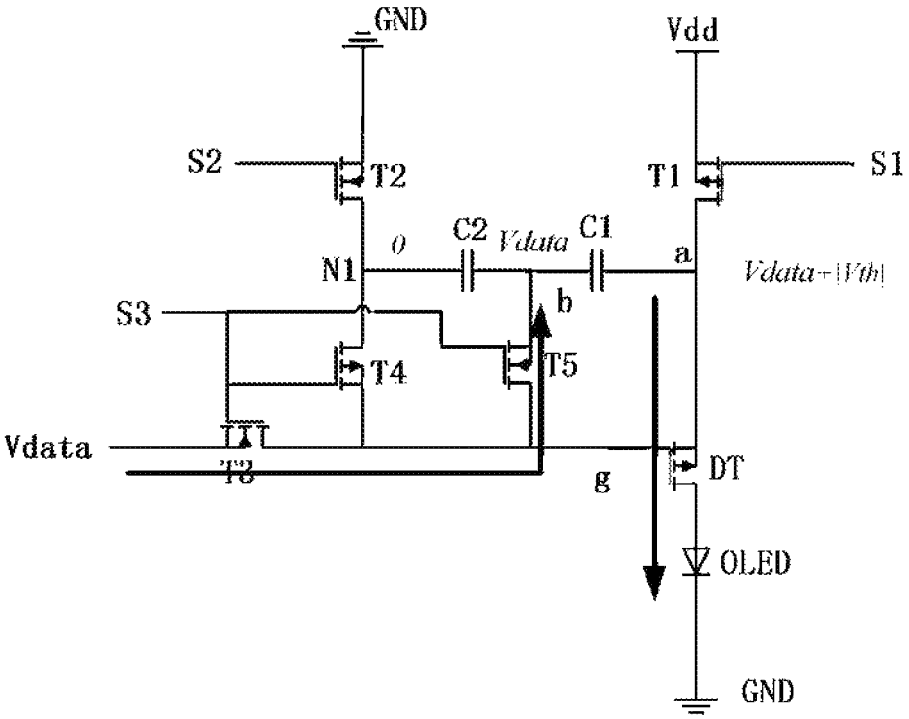
Figure 5C:
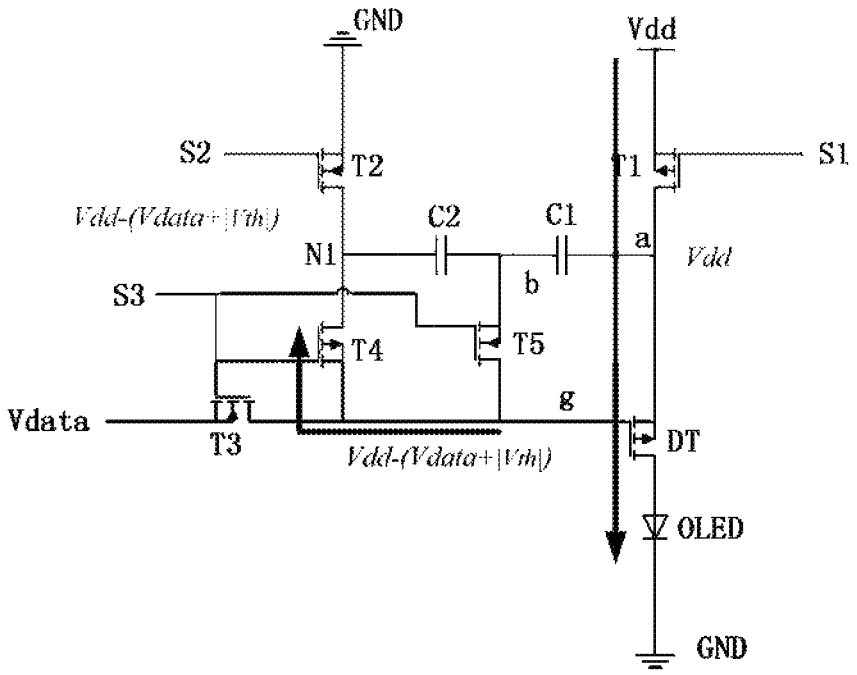

In the compensation phase D2, the control signal input terminals Si and S3 are applied with a high level, the control signal input terminal S2 is applied with a low level. The switch transistors T3 and T5 are turned on, the switch transistors T1, T2 and T4 are turned off. As shown in FIG. 5*b*, the voltage at the second end b of the capacitance C1 is still Vdata, the voltage at the first end a of the capacitance C1 begins to decline, the capacitance C1 begins to discharge through the drive transistor DT, the voltage at the end a of the capacitance C1 declines to be Vdata+|Vth| finally (wherein Vth is the threshold voltage of the drive transistor DT). The voltage across the capacitance C2 are still Vdata. Therefore, the series total voltage of the capacitances C1 and C2, i.e., the voltage difference between the node N1 and the first end a of the capacitance C1 is Vdata+|Vth|.

In the lighting phase D3, the control signal input terminals S1, S2 and S3 are all applied with a low level. The switch transistors T1 and T4 are turned on, the switch transistors T2, T3 and T5 are turned off The voltage at the first end a of the capacitance C1 is Vdd, the voltage at the node N1 jumps, which is jumped to be Vdd−(Vdata+|Vth|). Since the node N1 is conducted with the gate g of the drive transistor DT, the voltage at the gate g of the drive transistor DT is also Vdd−(Vdata+|Vth|).

Here, the current flowing through the OLED is:

$$\begin{aligned} I_{OLED} &= \frac{1}{2}\mu C_{OX}\frac{W}{L}(V_{gs}-|V_{th}|)^2 \\ &= \frac{1}{2}\mu C_{OX}\frac{W}{L}(V_{dd}-(V_{dd}-(V_{data}+|V_{th}|))-|V_{th}|)^2 \\ &= \frac{1}{2}\mu C_{OX}\frac{W}{L}(V_{data})^2 \end{aligned}$$

From the formula it can be seen that the current flowing through the OLED is only influenced by self-factors such as the carrier mobility μ of the drive transistor, the capacitance $C_{OX}$ of the gate oxide layer energy storage element, the size of the device itself (width W, length L). The current is controlled through the data voltage Vdata, and is unrelated to the threshold voltage Vth of the drive transistor and the power supply voltage Vdd. In this way, the problem of drift of the turn-on threshold value Vth caused by the process procedure and long time operation of the drive transistor DT will be solved thoroughly, the influence to the $I_{OLED}$ will be eliminated, thereby ensuring normal operation of the electroluminescent element OLED.

The present invention further provides a display device comprising any of the above pixel circuits.

The display device can be any product or component having the display function such as: electronic paper, a mobile phone, a panel computer, a television, a display, a laptop, a digital photo frame, a navigator.

What are stated above are only specific implementing modes of the present invention, however, the protection scope of the present invention is not limited to this. Any variations or replacements that can be easily conceived by the skilled person familiar with the present technical field within the technical scope disclosed by the present invention should be covered within the protection scope of the present invention. Therefore, the protection scope of the present invention should be subject to the protection scopes of the claims attached.

The invention claimed is:

1. A pixel circuit, comprising:

a drive transistor;

a first energy storage element;

and a driving module;

and having a reset voltage input terminal, a data voltage input terminal;

a working voltage input terminal;

and a plurality of control signal input terminals; wherein, a source of the drive transistor is connected with a first end of the first energy storage element;

the driving module is connected with a first end of the first energy storage element, a second end of the first energy storage element, a gate of the drive transistor, the reset voltage input terminal, the data voltage input terminal and the working voltage input terminal, and connects the plurality of control signal input terminals;

the driving module has a first node, when the first node and the second end of the first energy storage element are both floated, a voltage difference between the first node and the first end of the first energy storage element is kept constant;

the driving module connects the working voltage input terminal with the first end of the first energy storage element when a first control signal input terminal is inputted with a signal having an effective level; connects the first node with the reset voltage input terminal when a second control signal input terminal is inputted with a signal having an effective level; connects the data voltage input terminal with the gate of the drive transistor and the second end of the first energy storage element when a third control signal input terminal is inputted with a signal having an effective level; and connects the first node with the gate of the drive transistor when a fourth control signal input terminal is inputted with a signal having an effective level.

2. The pixel circuit as claimed in claim 1, wherein the driving module comprises:

a first switch transistor connected between the working voltage input terminal and the first end of the first energy storage element, a gate of the first switch transistor being connected with the first control signal input terminal;

a second switch transistor connected between the reset voltage input terminal and the first node, a gate of the second switch transistor being connected with the second control signal input terminal;

a third switch transistor connected between the data voltage input terminal and the gate of the drive transistor;

a fifth switch transistor connected between the second end of the first energy storage element and the gate of the drive transistor;

a fourth switch transistor connected between the first node and the gate of the drive transistor, a gate of the fourth switch transistor being connected with the fourth control signal input terminal; and a second energy storage element, a first end of the second energy storage element being connected with the second end of the first energy storage element, a second end of the second energy storage element being connected with the first node.

3. The pixel circuit as claimed in claim 2, wherein gates of the third switch transistor and the fifth switch transistor are both connected with the third control signal input terminal, and have a same effective level.

4. The pixel circuit as claimed in claim 3, wherein the respective switch transistors are all P-type transistors.

5. The pixel circuit as claimed in claim 3, wherein the effective level of the fourth switch transistor is opposite to the effective level of the third switch transistor and the fifth switch transistor, the fourth control signal input terminal and the third control signal input terminal are the same input terminal.

6. The pixel circuit as claimed in claim 5, wherein the first switch transistor and the fourth switch transistor are both P-type transistors; the second switch transistor, the third switch transistor and the fifth switch transistor are all N-type transistors.

7. The pixel circuit as claimed in claim 2, wherein the first energy storage element and/or the second energy storage element are capacitance.

8. The pixel circuit as claimed in claim 1, wherein the drive transistor is a P-type transistor.

9. A method for driving the pixel circuit as claimed in claim 1, characterized in that the method comprising a reset phase, a compensation phase and a lighting phase:

in the reset phase, the first control signal input terminal, the second control signal input terminal and the third control signal input terminal are all inputted with a corresponding effective level; the fourth control signal input terminal is inputted with a corresponding ineffective level;

in the compensation phase, the third control signal input terminal is inputted with a corresponding effective level; the first control signal input terminal, the second control signal input terminal and the fourth control signal input terminal are inputted with a corresponding ineffective level;

in the lighting phase, the first control signal input terminal and the fourth control signal input terminal are inputted with a corresponding effective level; the second control signal input terminal and the third control signal input terminal are inputted with a corresponding ineffective level.

10. The method as claimed in claim 9, wherein the driving module comprises:

a first switch transistor connected between the working voltage input terminal and the first end of the first energy storage element, a gate of the first switch transistor being connected with the first control signal input terminal;

a second switch transistor connected between the reset voltage input terminal and the first node, a gate of the second switch transistor being connected with the second control signal input terminal;

a third switch transistor connected between the data voltage input terminal and the gate of the drive transistor;

a fifth switch transistor connected between the second end of the first energy storage element and the gate of the drive transistor;

a fourth switch transistor connected between the first node and the gate of the drive transistor, a gate of the fourth switch transistor being connected with the fourth control signal input terminal; and a second energy storage element, a first end of the second energy storage element being connected with the second end of the first energy storage element, a second end of the second energy storage element being connected with the first node.

11. The method as claimed in claim 10, wherein gates of the third switch transistor and the fifth switch transistor are both connected with the third control signal input terminal, and have a same effective level.

12. The method as claimed in claim 11, wherein the respective switch transistors are all P-type transistors.

13. The method as claimed in claim 11, wherein the effective level of the fourth switch transistor is opposite to the effective level of the third switch transistor and the fifth switch transistor, the fourth control signal input terminal and the third control signal input terminal are the same input terminal.

14. The method as claimed in claim 13, wherein the first switch transistor and the fourth switch transistor are both P-type transistors; the second switch transistor, the third switch transistor and the fifth switch transistor are all N-type transistors.

15. The method as claimed in claim 10, wherein the first energy storage element and/or the second energy storage element are capacitance.

16. The method as claimed in claim 9, wherein the drive transistor is a P-type transistor.

17. A display device, comprising the pixel circuit as claimed in claim 1.

18. The display device as claimed in claim 17, wherein the driving module comprises:

a first switch transistor connected between the working voltage input terminal and the first end of the first energy storage element, a gate of the first switch transistor being connected with the first control signal input terminal;

a second switch transistor connected between the reset voltage input terminal and the first node, a gate of the second switch transistor being connected with the second control signal input terminal;

a third switch transistor connected between the data voltage input terminal and the gate of the drive transistor;

a fifth switch transistor connected between the second end of the first energy storage element and the gate of the drive transistor;

a fourth switch transistor connected between the first node and the gate of the drive transistor, a gate of the fourth switch transistor being connected with the fourth control signal input terminal; and a second energy storage element, a first end of the second energy storage element being connected with the second end of the first energy storage element, a second end of the second energy storage element being connected with the first node.

19. The display device as claimed in claim 18, wherein gates of the third switch transistor and the fifth switch transistor are both connected with the third control signal input terminal, and have a same effective level.

20. The display device as claimed in claim 19, wherein the effective level of the fourth switch transistor is opposite to the effective level of the third switch transistor and the fifth switch transistor, the fourth control signal input terminal and the third control signal input terminal are the same input terminal.

* * * * *